United States Patent [19]

Swain

[11] 4,023,134

[45] May 10, 1977

[54] ELECTRIC FUSE HAVING MULTIPLE CURRENT PATHS CONNECTED IN PARALLEL

[75] Inventor: Kenneth W. Swain, North Hampton, N.H.

[73] Assignee: Gould Inc. Electric Fuse Division, Newburyport, Mass.

[22] Filed: May 10, 1976

[21] Appl. No.: 684,755

[52] U.S. Cl. ..... 337/293; 337/161; 337/229; 337/248; 337/295

[51] Int. Cl.[2] ..... H01H 85/04

[58] Field of Search ..... 337/159, 161, 162, 229, 337/247, 248, 293, 295, 290

[56] References Cited

UNITED STATES PATENTS

| | | | |
|---|---|---|---|
| 1,094,030 | 4/1914 | Sprong et al. | 337/229 |
| 2,067,977 | 1/1937 | Muncheryan | 337/295 X |
| 3,317,691 | 5/1967 | Bassani | 337/295 X |

FOREIGN PATENTS OR APPLICATIONS

| | | | |
|---|---|---|---|
| 1,128,536 | 4/1962 | Germany | 337/248 |
| 505,388 | 5/1939 | United Kingdom | 337/293 |

*Primary Examiner*—Robert J. Hickey
*Attorney, Agent, or Firm*—Erwin Salzer

[57] ABSTRACT

An electric fuse having a plurality of fusible elements connected in parallel. The fusible elements extend from the center region of one of the ferrules to the region of the other of the ferrules coextensive with one of the rims of the casing of the fuse. The ends of the fusible elements are conductively connected to the axially inner end surfaces of the ferrules. The plurality of fusible elements is formed by a self-sustained structural unit adapted to be telescoped in one single operation into the casing of the fuse, thus greatly facilitating the assembly of the fuse.

3 Claims, 6 Drawing Figures

ELECTRIC FUSE HAVING MULTIPLE CURRENT PATHS CONNECTED IN PARALLEL

BACKGROUND OF THE INVENTION

This invention relates to an improvement of the subject-matter of the patent application of Frederick J. Kozacka, filed 04/05/76, Ser. No. 673,375 for ELECTRIC FUSE AND PROCESS OF MANUFACTURING THE SAME.

The above referred-to patent application discloses a fuse structure that is, in effect, a fuse of the kind known as a "blind" soldered fuse, i.e. having no visible solder joints between the ferrules and the fusible elements. The fuses disclosed in the above patent application have the advantages of fuses that have no blind solder joints, and they allow, in particular to form solder joints while the two workpieces to be joined together are held in engagement under pressure. The structure disclosed in the above patent application is relatively difficult to assemble, particularly if the number of fusible elements that are connected in parallel is large. It is often necessary or desirable to provide electric cartridge fuses with a large number of fusible elements in order to achieve a relatively large current carrying capacity and to maximize the interface area of the fusible elements and the granular arc-quenching filler by which they are surrounded.

It is, therefore, the prime object of this invention to provide fuse structures that allow to simplify the process of assembly of fuses as disclosed in the above patent application. A more specific object of this invention is to provide fuse structures that allow to combine a simplification of assembly with an increase of the number of fusible elements which are connected in parallel, and with an increase, for any given current rating, of the interface area of the fusible elements and the granular arc-quenching filler by which the fusible elements are surrounded.

SUMMARY OF THE INVENTION

Fuses embodying this invention have a tubular casing of electric insulating material having rims at the ends thereof. The casing contains a pulverulent arc-quenching filler. A pair of ferrules is mounted on the ends of the casing. Each of said pair of ferrules has an axially inner end surface. A plurality of fusible elements forming parallel current paths extend from one of said pair of ferrules to the other of said pair of ferrules. One end of each of said plurality of fusible elements is conductively connected to the center region of said axially inner end surface of one of said pair of ferrules. The other end of each of said plurality of fusible elements is conductively connected to the other of said pair of ferrules at the interface between one of said rims of said casing and said axially inner end surface of said other of said pair of ferrules. The aforementioned plurality of fusible elements form a self-sustained structural unit adapted to be telescoped in one single operation into said casing of said fuse.

DESCRIPTION OF PREFERRED EMBODIMENTS

Figure 1:
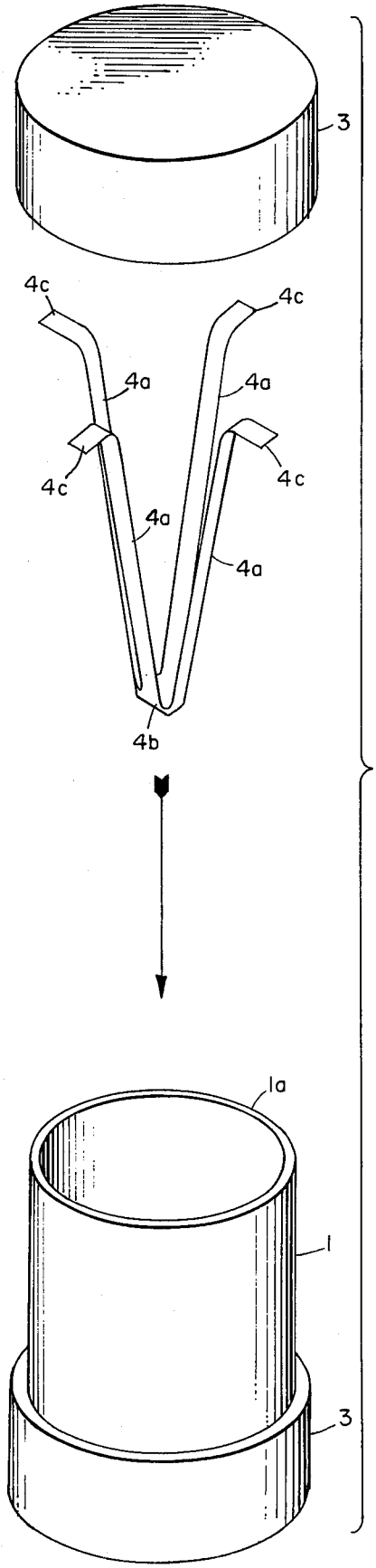
FIG. 1 is an isometric exploded view of the principal components of a fuse embodying this invention, deleting the pulverulent arc-quenching filler which forms part of the fuse.
Figure 4:
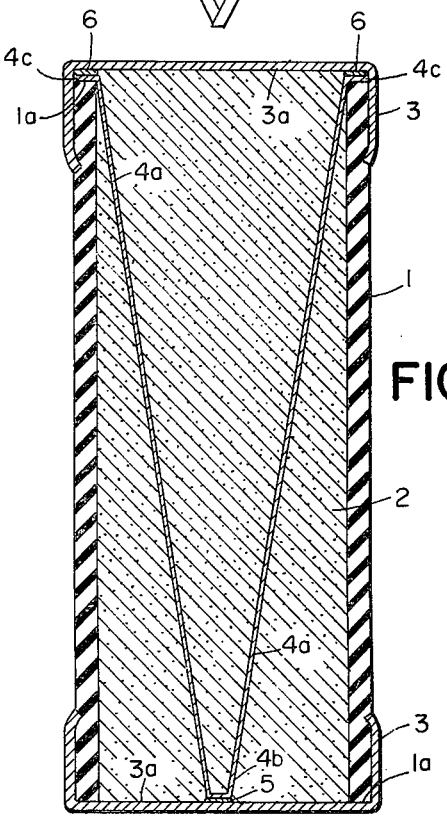
FIG. 4 is a cross-section of a fuse embodying this invention.

Referring now to the drawings, and more particularly to FIGS. 1 and 4 thereof, numeral 1 has been applied to indicate a tubular casing of electric insulating material, e.g. of vulcanized fiber or of a synthetic-resin-glass-cloth laminate. Casing 1 has circular rims 1*a* at the ends thereof and it is filled with a pulverulent arc-quenching filler 2, e.g. quartz sand. A pair of ferrules 3 is mounted on the ends of casing 1. Each of the ferrules 3 has an axially inner end surface 3*a*. Ferrules 3 are conductively interconnected by a plurality of fusible elements 4*a*. One end 4*b* of each of said plurality of fusible elements 4*a* is conductively connected to the center region of the radially inner end surface 3*a* of one of ferrules 3. This conductive connection may be implemented by a solder joint 5. The other end 4*c* of each of said plurality of fusible elements is conductively connected to the other of said pair of ferrules 3 at the interface between one of the rims 1*a* of casing 1 and the axially inner end surface 3*a* of the upper ferrule 3. The conductive connections between ends 4*c* of fusible elements 4*a* and upper ferrule 3 may be implemented by solder joints 6. Fusible elements 4*a* form a self-sustained structural unit adapted to be telescoped in one single operation into the casing 1 of the fuse.

In order to assemble the structure of FIG. 4 first the lower ferrule 3 is mounted on casing 1, and then the structural unit formed principally by fusible elements 4*a* is telescoped from the top end of casing 1 into the latter. Thereafter solder joint 5 is established and casing 1 is filled with the arc-quenching filler 2. The next step is spreading solder on the ends 4*c* of fusible elements 4*a* and then the upper ferrule 3 is mounted on casing 1. Finally the upper ferrule 3 is heated from the outside thereof, resulting in solder joints 6.

Figure 2A:
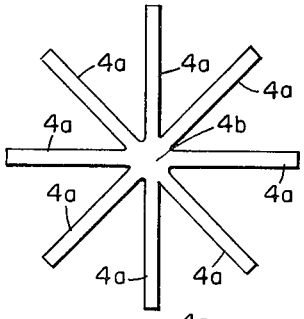
FIG. 2*a* is a top-plan view of a stamping that may be bent to form a plurality of fusible elements connected in parallel.
Figure 2B:
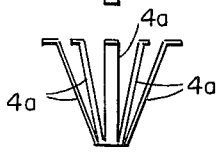
FIG. 2*b* is a side elevation of the stamping of FIG. 2*a* upon being bent in such a way that it can be telescoped in one single operation into the casing of a fuse.

Referring now to FIG. 2*a*, this figure shows a stamping having a center portion formed by the ends 4*b* of fusible elements 4*a*. The stamping has a plurality of angularly displaced projections forming integral parts of center portion 4*b* and extending radially outwardly from center portion 4*b*. FIG. 2*b* shows the stamping of FIG. 2*a* bent to form the telescopable insert for casing 1.

It is apparent from FIG. 2*a* that in that particular embodiment of the invention a large portion of the sheet metal used to make the stamping does not go into the latter, but results in scrap. This is, however, not a serious limitation since the scrap can be recovered and reprocessed at relatively moderate cost.

Figure 3A:
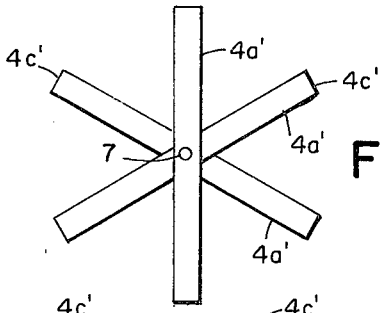
FIG. 3*a* is a top-plan view of a plurality of metal strips rivetted together at their centers and intended to form upon proper bending a plurality of parallel connected current paths.
Figure 3B:
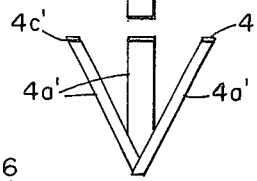
FIG. 3*b* is a side elevation of the structure shown in FIG. 3*a* upon being properly bent to form a plurality of parallel connected current paths.

The structure of FIG. 3*a* and FIG. 3*b* is made up of 3 straight metal strips 4*a*′ intersecting a their centers at angles of 60°. A rivet 7 projects through the 3 strips 4*a*′, thus integrating them into a structural unit adapted, upon being properly bent or shaped, as shown in FIG. 3*b*, to be telescoped in one single operation into the casing of a fuse. Thereafter strips 4*a'* are conductively connected at their center region, i.e. the region where rivet 7 is located, to the axially inner end surface of one of the pair of ferrules of an electric fuse. The radially outer ends 4*c'* of fusible elements or metal strips 4*a'* are conductively connected to the axially inner end surface of the other of the pair of ferrules of the fuse at the region where said other of the pair of ferrules engages one of the rims of the casing of the fuse.

I claim as my invention:

1. An electric fuse including a. a tubular casing of electric insulating material having rims at the ends thereof;

b. a pulverulent arc-quenching filler inside said casing;

c. a pair of ferrules mounted on the ends of said casing each having an axially inner end surface; and d. a plurality of fusible elements forming parallel current paths extending from one of said pair of ferrules to the other of said pair of ferrules, one end of each of said plurality of fusible elements being conductively connected to the center region of said axially inner end surface of one of said pair of ferrules and the other end of each of said plurality of fusible elements being conductively connected to the other of said pair of ferrules at the interface between one of said rims of said casing and said axially inner end surface of said other of said pair of ferrules, and said plurality of fusible elements forming a self-sustained structural unit adapted to be telescoped in one single operation into said casing of the fuse.

2. An electric fuse as specified in claim 1 wherein said structural unit is formed by a single stamping having a center portion and a plurality of angular displaced projections forming integral parts of said center portion and extending radially outwardly from said center portion.

3. An electric fuse as specified in claim 1 wherein said structural unit is formed by a plurality of separate elongated strips of equal length joined together at the center regions thereof and being angularly displaced, said strip being of such length that the ends thereof remote from said center region are positioned on a circle coextensive with said one of said rims of said casing.

* * * * *